US006371221B1

(12) United States Patent
Harrigan et al.

(10) Patent No.: US 6,371,221 B1
(45) Date of Patent: Apr. 16, 2002

(54) CORING BIT MOTOR AND METHOD FOR OBTAINING A MATERIAL CORE SAMPLE

(75) Inventors: Edward Harrigan, Richmond, TX (US); Gary W. Contreras, Valencia, CA (US); Bunker M. Hill, Sugar Land, TX (US); Robert W. Sundquist, The Woodlands, TX (US); Dean W. Lauppe, Pasadena, TX (US); Sony Tran, Missouri City, TX (US)

(73) Assignee: Schlumberger Technology Corporation, Houston, TX (US)

( * ) Notice: Subject to any disclaimer, the term of this patent is extended or adjusted under 35 U.S.C. 154(b) by 16 days.

(21) Appl. No.: 09/669,190

(22) Filed: Sep. 25, 2000

(51) Int. Cl.[7] ..... E21B 7/08
(52) U.S. Cl. ..... 175/26; 175/62; 175/81
(58) Field of Search ..... 175/62, 26, 23, 175/79, 77, 80, 81, 82, 170, 258

(56) References Cited

U.S. PATENT DOCUMENTS 4,280,568 A 7/1981 McPhee et al.
4,339,947 A 7/1982 Wiley
4,354,558 A 10/1982 Jageler et al.
4,396,074 A 8/1983 Jageler et al.
4,449,593 A 5/1984 Jageler et al.
4,466,495 A 8/1984 Jageler
4,609,056 A 9/1986 Colle, Jr. et al.
4,702,168 A 10/1987 Colle, Jr. et al.
4,714,119 A 12/1987 Hebert et al.
5,105,894 A 4/1992 Enderlin
5,163,522 A 11/1992 Eaton et al.
5,209,309 A 5/1993 Wilson
5,411,106 A 5/1995 Maissa et al.
5,439,065 A 8/1995 Georgi
5,617,927 A 4/1997 Maissa
5,667,025 A 9/1997 Haessly et al.

*Primary Examiner*—Frank S. Tsay
(74) *Attorney, Agent, or Firm*—John J. Ryberg; Steven L. Christian; Jennie (JL) Salazar

(57) ABSTRACT

The present invention provides an improved coring motor for use in obtaining a core sample from the side wall of a drilled bore hole. The present invention provides controllable rotation, extension and retraction of the coring bit relative to the side wall without complicated positioning linkages and with conservation of space for use in slim tools for use downhole.

16 Claims, 4 Drawing Sheets

CORING BIT MOTOR AND METHOD FOR OBTAINING A MATERIAL CORE SAMPLE

FIELD OF THE INVENTION

The present invention provides an improved coring bit motor and a method for obtaining a material core sample from the side wall of a drilled well.

BACKGROUND OF THE RELATED ART

Wells are generally drilled into the earth's crust to recover natural deposits of hydrocarbons and other desirable and naturally occurring materials trapped in geological formations. A slender well is drilled into the ground and directed to the targeted geological location from a drilling rig at the surface. In conventional "rotary drilling" operations, the drilling rig rotates a drillstring comprised of tubular joints of steel drill pipe connected together to turn a bottom hole assembly (BHA) and a drill bit that are connected to the lower end of the drillstring. During drilling operations, a drilling fluid, commonly referred to as drilling mud, is pumped and circulated down the interior of the drillpipe, through the BHA and the drill bit, and back to the surface in the annulus.

Coring is generally a process of removing an inner portion of a material by cutting with an instrument. While some softer materials may be cored by forcing a coring sleeve translationally into the material, for example soil or an apple, harder materials generally require cutting with rotary coring bits; that is, hollow cylindrical bits with cutting teeth disposed about the circumferential cutting end of the bit. The cored material is generally captured within the coring apparatus for retrieval from the well bore. Coring is typically used to remove unwanted portions of a material or to obtain a representative sample of the material for analysis to obtain information about its physical properties. Coring is extensively used to determine the physical properties of downhole geologic formations encountered in mineral or petroleum exploration and development.

Conventional coring of wells drilled to recover naturally occurring hydrocarbons is performed using a coring bit and core barrel attached to the end of the drill string. The core is captured inside the core barrel as the rotating coring bit penetrates the formation of interest. This coring process substantially disrupts the normal drilling process because the drill bit has to be removed from the end of the drill string and replaced with a coring bit. Coring in this manner can be very time consuming and costly. However, this method usually provides for a high rate of success for obtaining core samples for all of the formation drilled through in this manner.

Conventlonal side wall rotary coring is characterized by the use of a coring bit with a hollow, cylindrical configuration and cutting teeth embedded about the circumference of one open end. The coring bit is generally rotated about its axis as it is forced against the side wall of the well. As a core sample is cut from the side wall, the core sample is received into the hollow barrel defined by the interior walls of the coring bit. The optimal speed of rotation of the coring bit and the optimal weight on bit (the magnitude of the axial force urging the bit into the side wall) are generally determined by the type of formation being cored and by the physical characteristics of the coring bit.

Petroleum and other naturally occurring deposits of minerals or gas often reside in porous geologic formations deep in the Earth's crust. A formation of interest in a drilled well can be investigated using a coring tool to obtain representative samples of rock taken from the wall of the well adjacent to the formation of interest. The representative rock sample is generally cored from the formation using a hollow, cylindrical coring bit. Rock samples obtained through side wall coring are generally referred to as "core samples." Core samples are physically removed from the wall of the well and retrieved within the coring tool to be transported to the surface.

Analysis and study of core samples enables engineers and geologists to assess important formation parameters such as the reservoir storage capacity (porosity), the flow potential (permeability) of the rock that makes up the formation, the composition of the recoverable hydrocarbons or minerals that reside in the formation, and the irreducible water saturation level of the rock. These estimates are crucial to subsequent design and implementation of the well completion program that enables production of selected formations and zones that are determined to be economically attractive based on the data obtained from the core sample.

Several coring tools and methods of obtaining core samples have been used for conventional side wall coring. There are generally two types of coring methods and apparatus, namely rotary coring and percussion coring. The present invention is directed towards rotary coring, the more preferred method because of the quality of the core sample obtained.

Rotary coring of side walls generally involves forcing an open and exposed circumferential cutting end of a hollow cylindrical coring bit against the wall of the well and rotating the coring bit to promote cutting at the leading end. The coring tool is secured against the wall of the well at the zone or formation of interest with the rotary core bit oriented towards the wall of the well. The coring bit is deployed radially outwardly away from the coring tool axis and toward the wall of the well.

The coring bit is generally coupled to a coring motor through an extendable shaft or mechanical linkage. The shaft or linkage advances the rotating coring bit axially towards the side wall to bring the cutting end of the coring bit into contact with the side wall. The coring bit penetrates into the side wall by removing rock within a cylindrical cutting zone. The circumferential cutting end of the coring bit has a plurality of teeth and is often embedded with carbides, diamonds or other materials with superior hardness for cutting rock.

A cylindrically-shaped core sample is received into the hollow interior of the coring bit as cutting of the core sample progresses. After a core sample of the desired length is received, the core sample is broken free from the formation rock by breaking the remaining connection (radial cross-section) within the open, cutting end of the coring bit. The core bit and the core sample within it are retrieved into the coring tool by retracting the shaft or linkage used to extend the coring bit to its deployed position. The retrieved core sample may be ejected from the coring bit within the coring tool to allow use of the coring bit for obtaining subsequent samples at the same or different depths.

Rotary coring is the preferred method of obtaining a core sample because the core sample retains its flow and storage properties without the fracturing and compaction involved in percussion coring. However, efficient rotary coring requires efficient use of limited space. Because of the number of components and the physical manipulations required to recover a conventional side wall core sample, conventional rotary side wall coring presents many challenges associated with the limited space available downhole. As wells are successfully being drilled to deeper formations, and as directional wellbores reach further and further from the true vertical location of the surface location, these wells necessarily become more slender, thereby providing less space for positioning, deploying and operating conventional coring devices.

While it is favorable to obtain as large a representative sample as can be had from the side wall, there are physical limitations that make obtaining a larger core sample difficult and costly. The length of the core sample is limited by the stroke or travel of the coring bit. That is, from the time the cutting teeth of the coring bit initially touch the side wall, the maximum axial displacement into the side wall is determined by the mechanical characteristics of the coring tool.

The mechanical configuration of prior art coring tools is dictated by several different parameters. For cutting, the rotary coring bit must be rotated on its axis using some portable source of mechanical power contained within the coring tool. Motors that turn the core bit in coring tools are typically hydraulic motors driven by high pressure oil provided by an electrically powered pump. The electrically powered hydraulic oil pump is powered by electricity provided to the motor through the conductive cable that is used to lower, raise, control and to generally position the coring tool within the wellbore. Rotation of the coring bit is typically obtained by coupling the coring bit to the hydraulic motor using a mechanical linkage. Furthermore, upon deployment the coring bit must be extended from within the coring tool housing outwardly to the external side wall, and then further extended into the side wall during rotation of the coring bit to cut the core sample. Finally, after cutting of the core sample is completed, the coring bit and the core sample contained therein must be retracted to within the coring tool. If other subsequent core samples are to be obtained using the same coring bit, the core sample must be ejected from the coring bit and stored within the coring tool for transport to the surface. All of the mechanical devices, the hydraulic motor, the mechanical linkage from the motor to the coring bit for rotating and extending the bit, and the coring bit itself, must be "stored" in their inactive configuration within the slender coring tool housing until the tool is in position adjacent to the zone of interest in the side wall. When used, the coring tool must provide the needed rotation, as well as the extension and retraction of the coring bit in order to successfully obtain the core sample. The physical and dimensional challenges are substantial, and the present invention provides a more efficient and compact device and method for obtaining the core sample.

Additionally coring devices in the prior art are generally very mechanically complex and as such are prone to a wide variety of failures during operation, making them highly unreliable in the downhole environment. As a result, many oil companies are reluctant to use them due to the often poor success rate in recovering side wall core samples.

What is needed is a device that can extend and apply force through the coring bit against the side wall, retract the coring bit to within the coring tool after the core sample is obtained, and turn the coring bit at a desirable angular velocity throughout the process of cutting the core sample. What is needed is a device that can extend, retract and rotate the coring bit without complex mechanical linkages that take up valuable space, i.e. an efficiently "packaged" device that, when in the inactive, undeployed position, takes up little space within the coring tool. What is needed is an improved coring motor that is sufficiently compact that two or more coring motors can be used in a single coring tool to obtain multiple samples.

The present invention provides a solution to the problem of side wall conventional coring in the limited-space environment of slender wellbores. The retrieval and analysis of core samples in their undamaged condition provides valuable geologic information that drastically improves analysis and decision-making on the part of the oil company geologist.

SUMMARY OF THE INVENTION

The present invention provides an improved coring motor that is actually two motors, a spin motor and a thrust motor, working together to control the rotation, weight-on-bit and extension or retraction of the coring bit. The spin motor is comprised of a spin stator, a spin rotor and a spin rotor sleeve. The thrust motor is similarly comprised of a thrust stator, a thrust rotor and a thrust rotor sleeve. These two motors are each coupled to a specially designed drive shaft that is connectable at its end to a coring bit. The drive shaft is designed to rotate by operation of the spin motor and to extend and retract by operation of the thrust motor. The extension of the drive shaft and coring bit toward the side wall, and the subsequent retraction of the drive shaft and coring bit back to within the coring tool, are effected by varying the speed of the thrust motor relative to the speed of the spin motor. This design allows extremely efficient packaging of one or more of the improved coring motors within a single downhole coring tool.

DETAILED DESCRIPTION OF THE INVENTION

Figure 1:
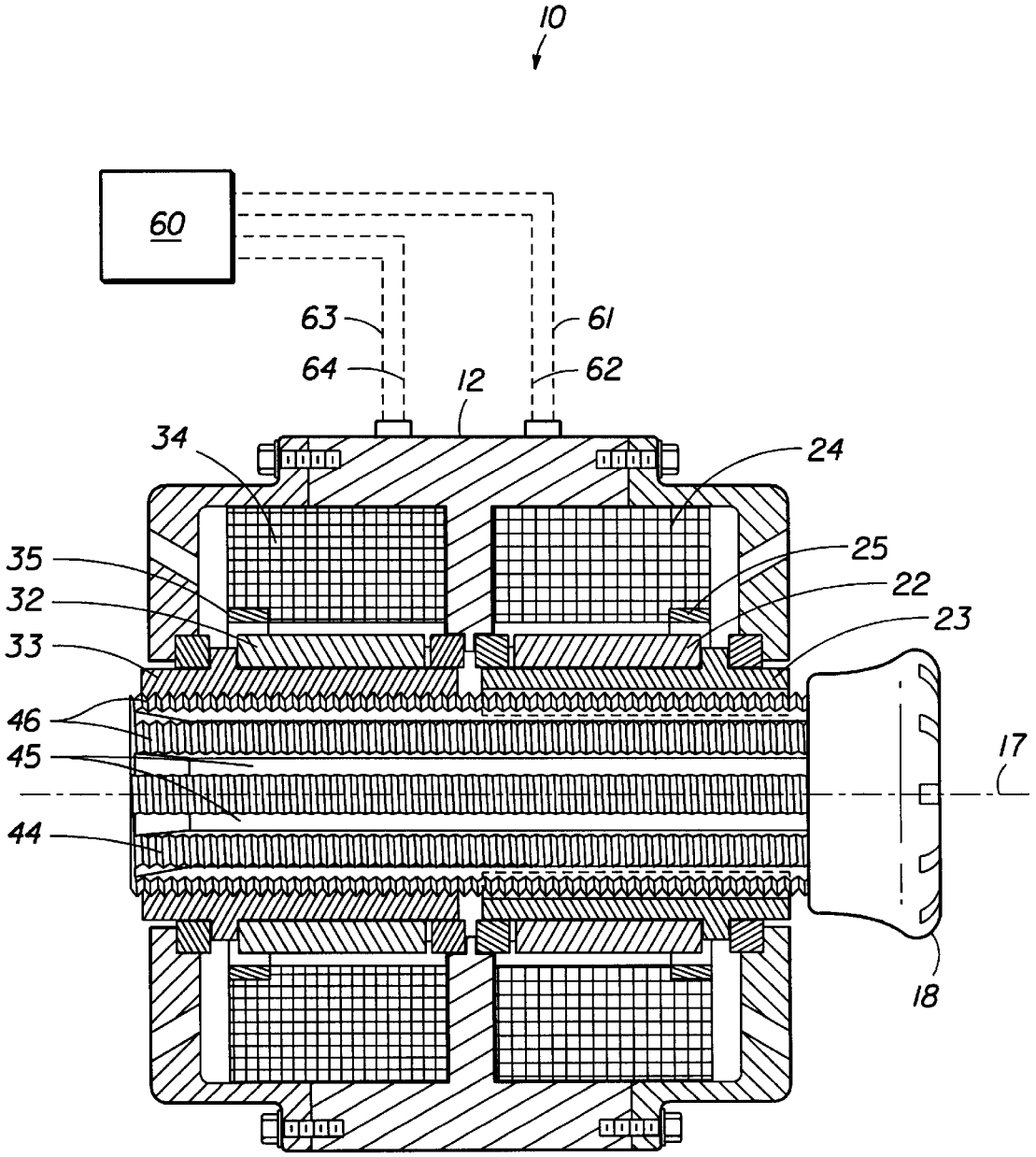
FIG. 1 is a side cross sectional view showing the improved coring motor in its undeployed position.
Figure 2:
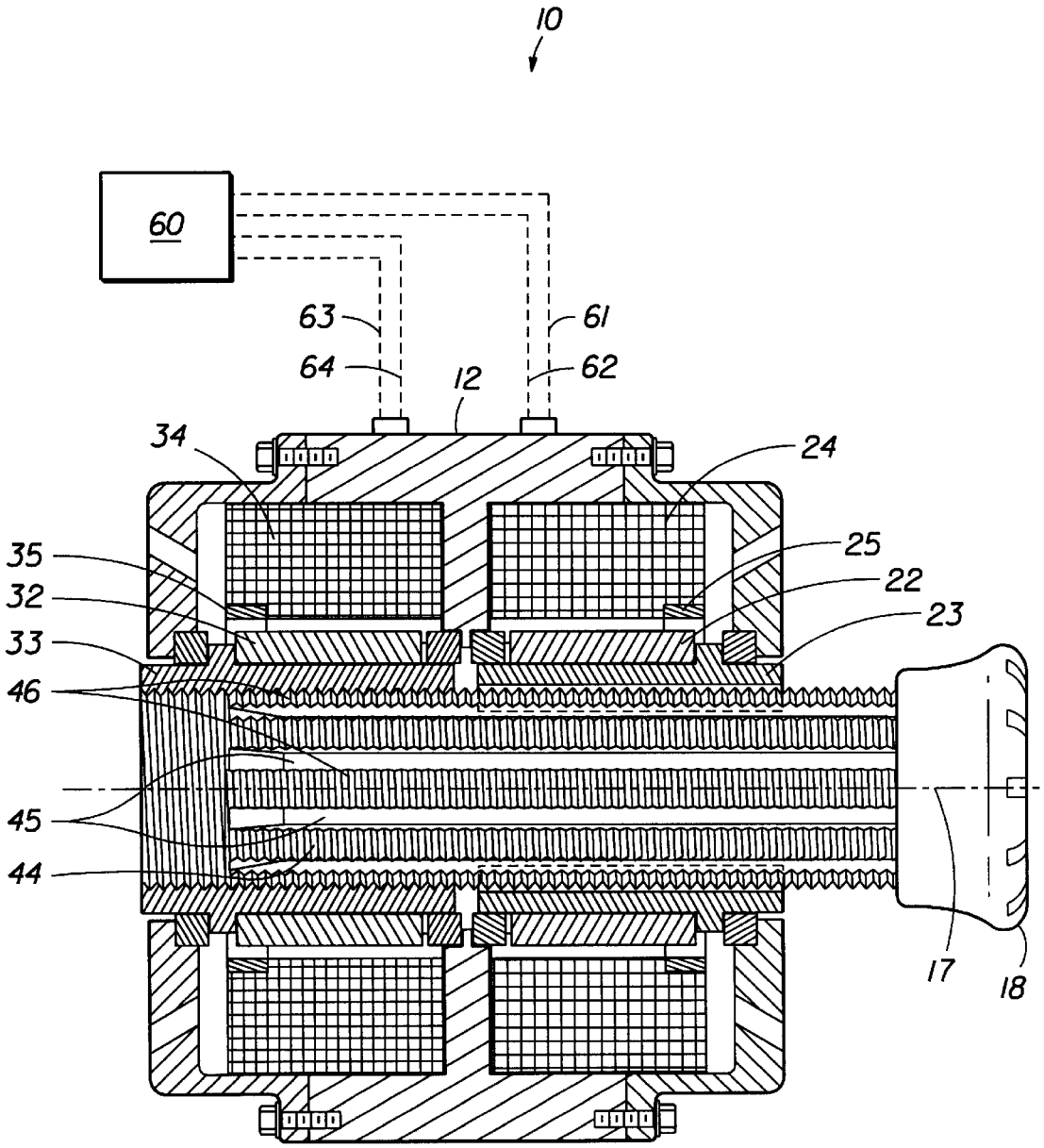
FIG. 2 is a side cross sectional view showing the improved coring motor in its partially deployed position.

FIGS. 1 and 2 are cross sectional views of a preferred embodiment of the coring tool 10 of the present invention in its undeployed and partially deployed configurations, respectively. A partially deployed configuration is intended to mean that the drive shaft 44 and coring bit 18 have been partially extended outwardly from the coring tool 10 toward their deployed position that correlates to the coring of a side wall core sample.

The coring apparatus 10 comprises two separate or independent motors that are cooperatively controlled: a spin motor for turning the drive shaft 44 and a thrust motor for axially displacing the drive shaft 44 while it turns, with axial displacement either towards the guide wall for coring (the right-hand direction of FIGS. 1 and 2) or retracting from the side wall for retraction into the coring tool 10. The power required to turn the drive shaft 44 during the coring process will likely exceed that required to extend the drive shaft 44 into the formation. It is likely, therefore, that the spin motor will be larger, and will generate more power, than will the thrust motor. The spin motor comprises a spin stator 24, a spin rotor 22 and a spin rotor sleeve 23, each concentrically disposed about a common central axis 17. The spin stator 24 typically comprises windings of electrically conductive wire wound to induce an electromagnetic moment upon the spin rotor 22 when electrical current is passed through the windings of the spin stator 24. The spin rotor 22 is disposed concentrically within the spin stator 24 and should be positioned in close electromagnetic communication with the spin stator 24 without coming into contact with the spin stator 24. This closely spaced relationship between the spin stator 24 and spin rotor 22 can be maintained in any conventional manner, including the mounting of the stator and rotor within a common structure or housing 12. While the spin stator 24 is stationary relative to the housing 12, the spin rotor 22 rotates about a central axis and is mounted or secured to the housing 12 on bearings or bushings.

Figure 3:
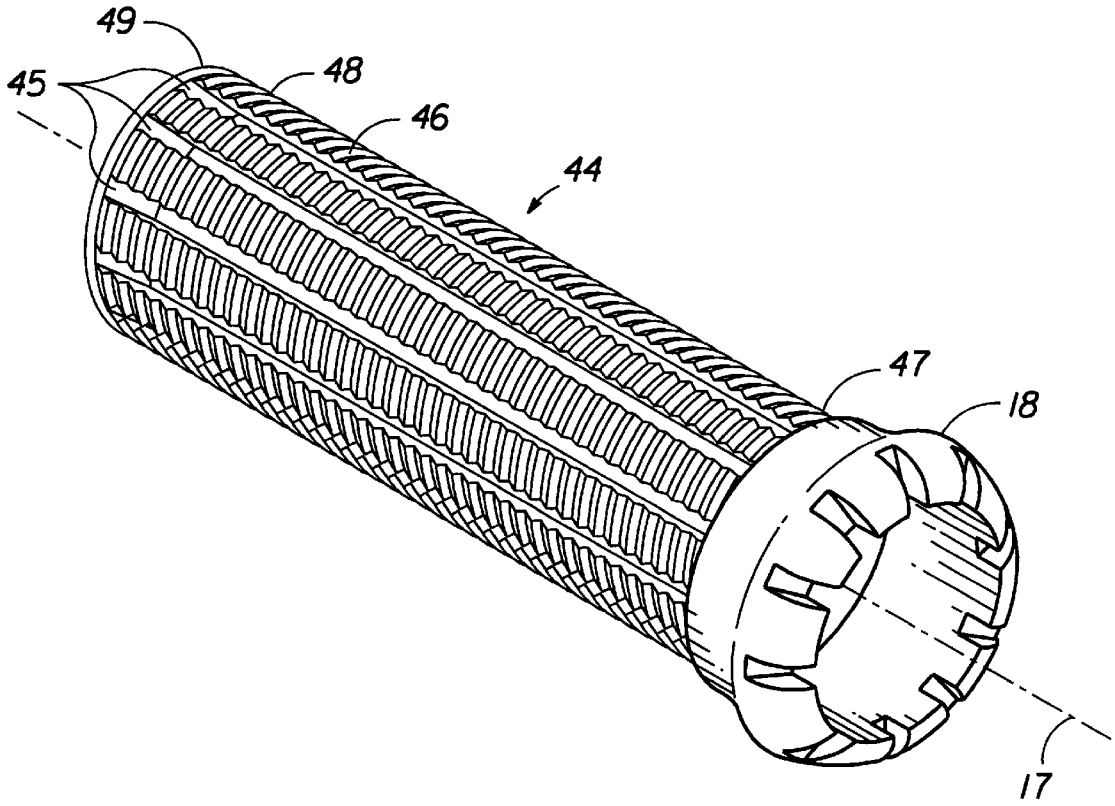
FIG. 3 is a perspective view showing the configuration of the drive shaft having axial shaft slots and threads superimposed on the shaft splines formed therebetween.
Figure 4:
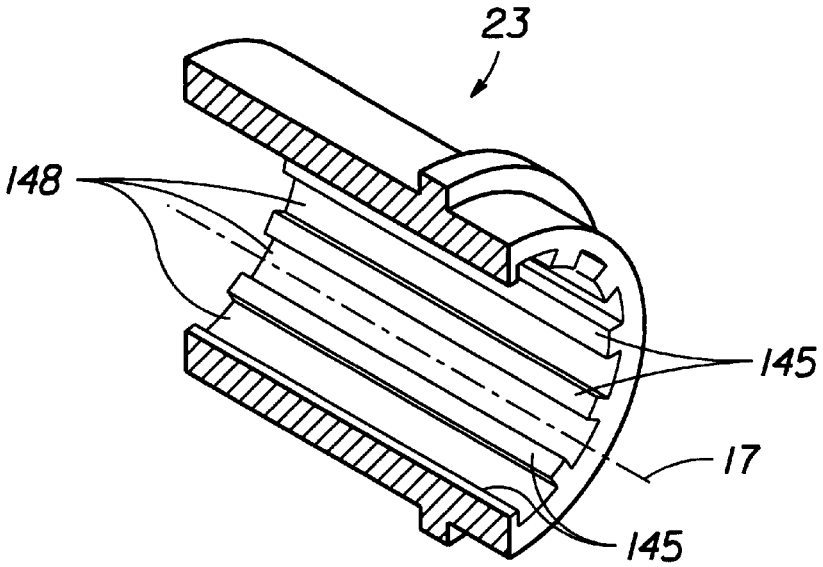
FIG. 4 is a perspective cross-sectional view showing the configuration of the spin rotor sleeve having internal splines designed to slidingly engage the shaft slots on the external surface of the drive shaft.

FIG. 4 is a perspective cross sectional view of the spin rotor sleeve 23 with its radially inwardly extending sleeve splines 145 that interface or mate with the corresponding shaft slots 45 of the drive shaft 44 shown in FIG. 3. The spin rotor sleeve 23 is a hollow cylindrical sleeve with an interior diameter equal to or slightly larger than the outer diameter of the drive shaft 44, and the sleeve splines 145 extending radially inward toward the hollow center of the of the spin rotor sleeve 23 are slidingly received within the shaft slots 45 of the drive shaft 44 as the spin rotor sleeve 23 is received upon the drive shaft 44. The spin rotor sleeve 23 is preferably coupled or fixed to the spin rotor 22. Alternatively, the spin rotor sleeve 23 and spin rotor 22 may be an integral component with the spin rotor sleeve 23 being formed on the interior surface of the spin rotor 22. In either manner, the spin rotor sleeve 23 has an interior-facing surface that is provided with splines.

Referring back to FIGS. 1 and 2, the thrust motor has similar construction to the spin motor. Specifically, the thrust motor comprises a thrust stator 34, a thrust rotor 32 and a thrust rotor sleeve 33, each concentrically disposed about a common central axis 17. The thrust stator 34 typically comprises windings of electrically conductive wire wound to induce a magnetic force upon the thrust rotor 32 when an electrical current is passed through the windings of the thrust stator 34. The thrust rotor 32 is disposed concentrically within the thrust stator 34 and should be positioned in close electromagnetic communication with the thrust stator 34 without coming into contact with the thrust stator 34. This closely spaced relationship between the stator and rotor can be maintained in any conventional manner, including the mounting of the stator and rotor within a common structure or housing 12. While the stator is stationary relative to the housing 12, the rotor rotates or spins about a central axis and, therefore, is mounted or secured to the housing on bearings or bushings.

Figure 5:
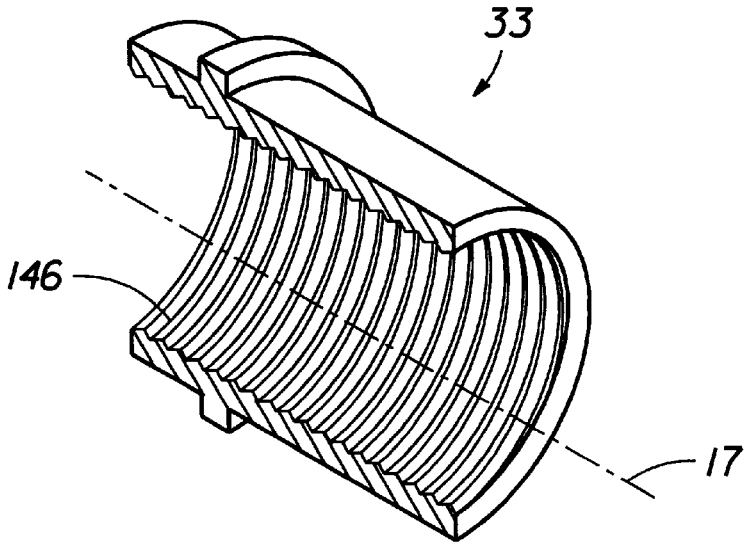
FIG. 5 is a perspective cross-sectional view showing the configuration of the thrust rotor sleeve having internal threads designed to engage the threads disposed on the shaft splines on the external surface of the drive shaft between the shaft slots.

FIG. 5 is a perspective cross sectional view of the thrust rotor sleeve 33 with threads 146 formed on the radially inward interior surface to mate with corresponding threads formed on the outer surface of the shaft splines 48 of the drive shaft 44 shown in FIG. 3. The thrust rotor sleeve 33 and the coupled thrust rotor 32 are rotated about the drive shaft 44 by the application of controlled electrical current 64 in the thrust stator 34. The thrust rotor sleeve 33 is preferably coupled or fixed to the thrust rotor 32. Alternatively, the thrust rotor sleeve 33 and thrust rotor 32 may be an integral component with the thrust rotor sleeve 33 being formed on the interior surface of the thrust rotor 32. In either manner, the thrust rotor sleeve has an interior-facing surface that is provided withthreads.

The spin rotor sleeve 23 and the thrust rotor sleeve 33 are coupled to a specially designed drive shaft 44 used for turning and applying weight-on-bit to a coring bit 18. The drive shaft 44, shown separately in FIG. 3, has an axis 17 and is connectable at its bit end 47 to the coring bit 18. The drive shaft 44 has an exterior surface with a plurality of shaft slots 45 extending along the length of the drive shaft 44, preferably extending from the bit end 47 to or nearly to the ejection end 49 of the drive shaft 44. These shaft slots 45 are preferably longitudinal and parallel to the axis 17 of the drive shaft 44, but they may be helical about the axis 17. Regardless of the exact shaft slot design, the shaft slots 45 are designed to be coupled with corresponding internal sleeve splines 145 in a spin rotor sleeve 23 having a common axis 17. The coupling of the slots and splines should be able to communicate a radial force from the rotor sleeve splines 145 to the shaft slots 45, yet allow for axial sliding of the sleeve splines 145 relative to the shaft slots 45. For example, the spin rotor sleeve 23 is preferably designed to continue rotating the drive shaft 44 as the drive shaft 44 advances, as determined by rotation of the thrust rotor sleeve 33, from its fully retracted, undeployed position shown in FIG. 1 to the intermediate, partially deployed position shown in FIG. 2 and on to a fully deployed position corresponding to full axial extension of the drive shaft 44.

The exterior surface of the drive shaft 44 is also provided with a plurality of threads 46 superimposed on the shaft splines 48 formed between the shaft slots 45 along the length of the drive shaft 44. These threads 46 may be provided with any pitch, depth or spacing, but it should be recognized that the pitch of the threads 46 will effect the degree of positional control and the weight on bit that the thrust motor can impart to the coring bit 18 while coring. The coupling of the threads on the thrust rotor sleeve 33 and the drive shaft 44 should be able to impart an axial or reciprocal force on the drive shaft 44.

When electrical current is passed through the windings of the spin stator 24, a moment is electromechanically applied to the spin rotor 22 and the spin rotor sleeve 23 coupled thereto, thereby causing these components to rotate about the axis 17. Rotation of the drive shaft 44 is achieved by rotating the spin rotor sleeve 23, which rotates the drive shaft 44 and transmits power to the coring bit 18. The rotational velocity of the drive shaft 44 is independently and accurately controllable by the electrical current 61 to the spin stator 24.

When electrical current is passed through the thrust stator 34, a moment is electromechanically applied to the thrust rotor 32 and the thrust rotor sleeve 33 coupled thereto, thereby causing these components to rotate about the axis 17 to axially extend, maintain, or retract the drive shaft 44. Axial or reciprocal movement of the drive shaft 44 is achieved by rotating the thrust rotor 32 and the thrust rotor sleeve 33 coupled thereto at an angular velocity unequal to that of the spin rotor sleeve 23. The rotation of the thrust rotor sleeve 33 and the threads 146 formed on the radially interior surface of the thrust rotor sleeve 33 axially displaces the drive shaft 44 by engagement of the threads 146 with the mating threads machined onto the shaft splines 48 on the drive shaft 44. The direction of rotation of the thrust rotor sleeve 33 and the configuration (right or left) of the threads thereon determines the axial motion of the drive shaft 44. Rotation of the thrust rotor 32 and the thrust rotor sleeve 33 (at an angular velocity unequal to that of the spin rotor sleeve 23) either advances the drive shaft 44 and the connected coring bit 18 towards the side wall (to the right in FIG. 1) or retracts the coring bit 18 to its inactive, undeployed position within the coring apparatus 10 (to the left in FIG. 1).

It is essential to obtaining a core sample that the coring tool 10 controllably advances the coring bit 18 toward and into the side wall as the coring bit 18 rotates to cut the core sample. Accordingly, the sleeve splines 145 (or at least one key or pin) in the spin rotor sleeve 23 must remain in mechanical and rotational contact with the shaft slot or slots 45 of the drive shaft 44 notwithstanding the axial displacement of the drive shaft 44 relative to the spin rotor sleeve 23. Similarly, weight-on-bit, i.e. axial force applied to the coring bit 18 through the drive shaft 44, is essential for the rotating coring bit 18 to efficiently cut and obtain the core sample. Accordingly, the threads 146 on the interior surface of the thrust rotor sleeve 33 must remain in mechanical contact with the corresponding threads on the shaft splines 48 of the drive shaft 44 notwithstanding rotation of the drive shaft 44 by the spin rotor sleeve 23. These conditions are satisfied by the unique design of the drive shaft 44 as shown in FIG. 3.

The rotational velocity of the drive shaft 44 is determined by and equal to the rotational velocity of the spin rotor 22 and the spin rotor sleeve 23 coupled thereto. If the rotational velocity of the spin rotor sleeve 23 and the thrust rotor sleeve 33 are equal, then the rotational velocity of the thrust rotor sleeve 33 is necessarily equal to the rotational velocity of the drive shaft 44. Under this operating condition, there will be no axial displacement of the drive shaft 44 because the rotating thrust rotor sleeve 33 remains stationary relative to the rotating drive shaft 44. Axial displacement of the rotating drive shaft 44 is achieved by varying the rotational velocity of the thrust rotor sleeve 33 relative to the rotational velocity of the drive shaft 44. Under this condition, the axial displacement of the drive shaft 44 relative to the thrust rotor sleeve 33 is calculated using the drive shaft rotational velocity, $W_{ds}$, the thrust rotor sleeve 33 rotational velocity, $W_{trs}$, and by the pitch of the threads (on the shaft splines and on the radially interior surface of the thrust rotor sleeve), $P_{threads}$.

Assuming the threads 146 on the rotating shaft 44 are right hand threads and that both the spin motor and the thrust rotor are rotating in a clockwise direction (as viewed from the coring bit end of the coring apparatus 10), the rate of penetration of the coring bit 18 can be determined by the equation:

$$V_{cb}=P_{threads}\times(W_{trs}-W_{ds}).$$

For example, if there are 10 threads per inch of drive shaft (the $P_{threads}$ is then 0.1 inch per thread), the $W_{tas}$ is 2005 rpm (revolutions per minute) and the $W_{ds}$ is 2000 rpm, the rate of penetration of the coring bit $V_{cb}$, determined by the rate of advance of the drive shaft 44 towards the side wall, will be (0.1×(2005−2000))=0.5 inches per minute or 0.0083 inches per second. Conversely, if the core sample has been successfully cut and obtained, the drive shaft 44 can be retracted to within the coring tool 10 by slowing the rotational velocity of the thrust rotor sleeve 33, $W_{trs}$, relative to the rotational velocity of the drive shaft 44, $W_{ds}$. For example, if $W_{ds}$ remains at 2000 rpm and $W_{trs}$ is reduced to 1950 rpm, the rate of retraction of the drive shaft 44 will be (0.1×(1950−2000))=−5 inches per minute, or −0.0833 inches per second (the negative sign indicates the coring bit is retracting). While the former rate of penetration of the coring bit, $V_{cb}$, of 0.5 inches per minute is more appropriate for efficient cutting of a core sample, the latter retraction rate of −5.0 inches per minute is the more appropriate speed for retracting the coring bit 18 back into the coring tool 10. A unidirectional motor can provide both extension and retraction of the drive shaft 44 and the connected coring bit 18 by varying the rotational velocities of the thrust rotor sleeve 33 and the spin rotor sleeve 23 one relative to the other. The coring tool 10 can be retrofitted with alternate threaded components to vary the speed of extension and retraction for given motor speeds to customize the dynamics of the coring process to suit the physical properties of the formation. Although the drawings provided show the preferred embodiment with the thrust stator 34, thrust rotor 32 and thrust rotor sleeve 33 near the ejection or "inboard" end 49 of the drive shaft 44, and the spin stator 24, spin rotor 22 and spin rotor sleeve 23 near the coring bit 18 or "outboard" end of the drive shaft 44, these two groups of closely related and interacting components can be reversed.

The preceding discussion demonstrates the accuracy required for efficient operation of the present invention. The 0.5 inch per minute penetration rate during coring is achieved by increasing and controlling the $W_{trs}$ to only 5 rpm over the $W_{ds}$, a difference of only 0.25%. Various means are available for enabling the exacting control of the electrical current 61 and 64 to achieve this level of control. Spin rotor monitor 25 and thrust rotor monitor 35 "count" the revolutions of the spin rotor 22 and the thrust rotor 32, respectively. The spin rotor monitor 25 and the thrust rotor monitor 35 may monitor the position of the respective rotors magnetically, optically, electronically or mechanically, or some combination of these. The spin rotor monitor 25 and the thrust rotor monitor 35 may detect a transponder that is mounted on the respective rotor being monitored, and the detected spin rotor position signal 62 and the detected thrust rotor position signal 63 are transmitted to the microprocessor 60. The microprocessor 60 calculates the rotational velocities of the spin rotor 22 and the thrust rotor 32, and automatically adjusts the electrical spin stator current 61 and the electrical thrust rotor current 64 to maintain the desired coring bit rotational velocity $W_{cb}$ (which is equal to the drive shaft 44 rotational velocity, $W_{ds}$) and the desired rate of penetration of the coring bit $V_{cb}$.

The drive shaft 44 may comprise a variety of configurations. In its basic configuration, the shaft slots 45 and the helical threads 46 are machined onto separate exterior portions of the drive shaft 44. In this configuration, the shaft slots 45 may reside on the drive shaft 44 near its bit end near the coring bit 18, and the helical threads 46 may reside on the drive shaft 44 near its ejection end 49 opposite the bit 18. In a more complex configuration, the helical threads 46 may be superimposed upon the shaft splines 48 that are founded between the shaft slots 45, as shown in FIG. 3. The shaft slots 45 may be axially aligned with the axis 17 of the drive shaft 44 (i.e., infinite pitch), or they may be helical about the axis 17 of the drive shaft 44. It should be understood that embodiments having helical shaft slots 45 and corresponding sleeve splines 145, in combination with helical threads 46 on the shaft splines 48 interfacing with corresponding threads 146 on the interior of the thrust rotor sleeve 33, actually superimpose a first set of threads onto a second set of threads on the exterior of the drive shaft 44. One of the sets of threads interfaces with a corresponding set of threads on the interior of the thrust rotor sleeve 33, and a second set of threads interfaces with a corresponding set of threads on the interior of the spin rotor sleeve 23. Naturally, when this approach is used, there must be sufficient differences in the depth and pitch of the two sets of threads in order to prevent interference and to promote independent interaction with the drive shaft 44.

The present invention offers improved packaging efficiency for coring tools. A coring tool may include multiple coring motors or coring modules of the present invention, all positioned within a single coring tool. These coring modules may be used simultaneously or in sequence to obtain core samples from varying depths. The coring modules may be electronically connected one to the others within a coring tool for control purposes. Each coring module would have a unique electronic address thereby enabling each coring module to be controlled independent of the other coring modules.

The use of multiple coring motors or coring modules within a single coring tool allows the elimination of complex core sample ejection mechanisms used in prior art coring tools to remove the retrieved core sample from the coring bit. The present invention offers a coring module that can retrieve the core sample to within the hollow interior of the drive shaft 44 that acts as a storage compartment for the retrieved core sample. The retrieved core sample would be removed from the coring module at the surface. Additional components, such as core sleeves, may be disposed within the interior of the drive shaft 44 to shield and protect the core sample from erosion or damage that may otherwise be caused by the interior wall of the drive shaft 44 during rotation.

The present invention is not intended to address the step of breaking the cut core sample free from its remaining interface with the formation after the coring bit 18 has penetrated the side wall to its extreme point of penetration. The core sample may be broken free of the formation by movement of the coring bit 18 relative to the formation. Once the core sample is broken free from the formation, it can be retrieved to within the coring tool 10 with the coring bit 18.

The present invention may also include electronic or physical means for stopping the axial displacement of the drive shaft 44 to eliminate the possibility of unwanted disengagement of the drive shaft from either of the rotor sleeves due to excessive travel of the drive shaft 44. Such means for stopping may include programming of the controller to track the position of the drive shaft 44 as a function of the relative number of rotations made by the two rotors/sleeves. Alternatively, the means for stopping may include a mechanical member formed on the drive shaft 44, spin rotor sleeve 23 or thrust rotor sleeve 33 that physically prevents unwanted thrust or axial advancement of the drive shaft 44. An example would be to eliminate or "fill in" a small portion of the splines on the exterior surface of the drive shaft 44 at the ejection end 49 of the drive shaft 44 as shown in FIG. 3. This structure provides for a secure means of preventing inadvertent disengagement of the drive shaft 44 from the thrust sleeve 33 during operation of the coring motor 10.

The meaning of "motor", as that term is used herein includes, but is not limited to, a device that consumes electrical energy and produces mechanical energy, and it may include an arrangement of more than one stator coupled with more than one rotor for turning, rotating or operating more than one mechanical output member. The meaning of "slots", as that term is used herein includes, but is not limited to, threads, ridges, guides, grooves and channels. The meaning of "splines" as that term is used herein includes, but is not limited to, ridges, threads, grooves and channels.

While the foregoing is directed to the preferred embodiment of the present invention, other and further embodiments of the invention may be devised without departing from the basic scope thereof, and the scope thereof is determined by the claims that follow.

We claim:

1. A sidewall coring apparatus comprising:

a spin motor having a spin stator and a spin rotor with one or more internal splines;

a thrust motor having a thrust stator and a thrust rotor with internal threads; and a tubular drive shaft having an axis, a bit end connectable to a coring bit, and an outer surface with one or more longitudinal slots superimposed with a set of threads, wherein the one or more longitudinal slots mate with the one or more internal splines of the spin rotor and the internal threads of the drive shaft mate with the threads of the thrust rotor.

2. The apparatus of claim 1, wherein the spin stator electromechanically engages and rotates the spin rotor about the axis of the tubular drive shaft thereby imparting controlled angular rotation to the spin rotor;

wherein the thrust stator electromechanically engages and rotates the thrust rotor about the axis of the tubular drive shaft thereby imparting controlled angular rotation to the thrust rotor; and wherein the bit end of the tubular drive shaft is controllably axially extendable and retractable during rotation of the tubular drive shaft by controlled differential angular rotation of the spin rotor relative to the thrust rotor.

3. The apparatus of claim 1, further comprising a controller for controlling the rotational speed of the spin motor and the thrust motor.

4. The apparatus of claim 1, wherein the one or more longitudinal slots are parallel to the axis of the drive shaft.

5. The apparatus of claim 1, wherein the one or more splines of the spin rotor are provided on a separate spin rotor sleeve.

6. The apparatus of claim 1, wherein the threads of the thrust rotor are provided on a separate thrust rotor sleeve.

7. A sidewall coring apparatus comprising:

a spin motor having a spin stator and a spin rotor;

a thrust motor having a thrust stator and a thrust rotor; and a tubular drive shaft having an axis, a bit end connectable to a coring bit, and an outer surface, wherein the spin rotor is rotationally, but not axially, coupled to the outer surface of the drive shaft, and wherein the thrust rotor is both rotationally and axially coupled to the outer surface of the drive shaft.

8. The apparatus of claim 7, wherein the spin rotor is rotationally coupled to the outer surface in a slot and spline relationship.

9. The apparatus of claim 7, wherein the thrust rotor is both rotationally and axially coupled to the outer surface by threaded engagement.

10. The apparatus of claim 7, wherein the spin rotor is directly adjacent to the thrust rotor.

11. An apparatus for performing sidewall coring, comprising:

a spin motor for producing a first torque;

a thrust motor for producing a second torque;

a tubular shaft;

means for converting the first torque into rotation of said shaft about its axis; and means for converting the second torque into translational motion of said shaft along its axis.

12. The apparatus of claim 11, wherein said spin motor includes a tubular spin stator and a tubular spin rotor for applying the first torque to the rotation converting means on said shaft.

13. The apparatus of claim 12, wherein the rotation converting means includes a spin rotor sleeve connected to the spin rotor, the spin rotor sleeve having splines extending inwardly from an inner surface thereof for engagement with slots formed in an outer surface of said tubular shaft.

14. The apparatus of claim 11, wherein said thrust motor includes a thrust stator and a thrust rotor for applying the second torque to the translational motion converting means on said shaft.

15. The apparatus of claim 14, wherein the translational motion converting means includes a thrust rotor sleeve having threads formed on an inner surface thereof for engagement with complementary threads formed on an outer surface of said tubular shaft.

16. A method of translating and rotating a coring bit during a sidewall coring operation, comprising the steps of:

connecting a coring bit to one end of a tubular member disposed in a downhole tool;

positioning the downhole tool within a wellbore adjacent a formation sidewall of interest;

inducing rotation of the tubular member with a tubular spin motor positioned concentrically about the member within the downhole tool;

inducing translational motion of the tubular member with a tubular thrust motor positioned concentrically about the member within the downhole tool such that the coring bit is urged into the formation sidewall; and inducing translational motion of the tubular member with the tubular thrust motor such that the coring bit is urged out of the formation sidewall.

* * * * *